United States Patent [19]

Sayovitz et al.

[11] Patent Number: 5,057,361

[45] Date of Patent: Oct. 15, 1991

[54] WETTABLE POLYMERIC FABRICS

[75] Inventors: John J. Sayovitz; Cheryl A. Perkins, both of Marietta, Ga.

[73] Assignee: Kimberly-Clark Corporation, Neenah, Wis.

[21] Appl. No.: 439,062

[22] Filed: Nov. 17, 1989

[51] Int. Cl.[5] ..... B32B 27/00

[52] U.S. Cl. ..... 428/290; 106/287.13; 106/287.16; 106/287.23; 428/266; 428/447; 524/800; 524/837

[58] Field of Search ..... 418/266, 290, 447; 524/800, 837; 106/287.13, 287.16, 287.23

[56] References Cited

U.S. PATENT DOCUMENTS

| | | | |
|---|---|---|---|
| 3,414,604 | 12/1968 | Pepe et al. | 260/448.8 |
| 3,511,699 | 5/1970 | Johnson et al. | 117/135.5 |
| 3,565,845 | 2/1971 | Johnson | 260/29.2 |
| 3,620,821 | 11/1971 | Jones | 117/126 |
| 3,833,512 | 9/1974 | Prokai | 252/356 |
| 3,980,688 | 9/1976 | Litteral et al. | 260/448 |
| 3,992,332 | 11/1976 | Zenon | 252/548 |
| 4,016,000 | 4/1977 | Prokai et al. | 106/316 |
| 4,016,163 | 4/1977 | Kanner et al. | 260/247.7 L |
| 4,020,212 | 4/1977 | Erickson | 428/361 |
| 4,025,456 | 5/1977 | Litteral et al. | 252/351 |
| 4,031,042 | 6/1977 | Prokai et al. | 260/2.5 AH |
| 4,045,381 | 8/1977 | Prokai et al. | 260/2.5 AH |
| 4,049,675 | 9/1977 | Kanner et al. | 260/332.1 |
| 4,076,648 | 2/1978 | Rosen | 25/358 |
| 4,184,004 | 1/1980 | Pines et al. | 428/413 |
| 4,228,054 | 10/1980 | Ona et al. | 260/29.2 M |
| 4,261,848 | 4/1981 | Reedy et al. | 252/78.3 |
| 4,269,992 | 5/1981 | Litteral et al. | 556/446 |
| 4,283,519 | 8/1981 | Pines et al. | 428/266 |
| 4,353,955 | 10/1982 | Cook | 428/266 |
| 4,359,545 | 11/1982 | Ona et al. | 524/262 |
| 4,446,279 | 5/1984 | Keogh | 525/106 |
| 4,535,113 | 8/1985 | Foster | 524/262 |
| 4,541,936 | 9/1985 | Ono et al. | 252/8.6 |
| 4,708,807 | 11/1987 | Kemerer | 428/266 |
| 4,781,973 | 11/1988 | Zotto | 428/266 |
| 4,837,029 | 6/1989 | Olsen | 424/451 |
| 4,871,611 | 9/1989 | LeBel | 428/290 |
| 4,908,140 | 3/1990 | Bausch et al. | 252/8.6 |

FOREIGN PATENT DOCUMENTS

| | | |
|---|---|---|
| 1198096 | 7/1970 | United Kingdom . |
| 1220471 | 1/1971 | United Kingdom . |
| 1220472 | 1/1971 | United Kingdom . |

OTHER PUBLICATIONS

Two computer searches.

*Primary Examiner*—James J. Bell
*Attorney, Agent, or Firm*—William D. Herrick

[57] ABSTRACT

A polymeric fabric having enhanced wettability, a method for producing such wettable polymeric fabric, and composition for us in the method are provided. The polymeric fabric comprises a primary surfactant on the surface of the polymeric fabric, the primary surfactant having a low solubility in water and dispersible in water. The primary surfactant is applied to the fabric in an aqueous solution. The primary surfactant is preferably applied to the fabric in a composiiton comprising the primary surfactant, water, and a co-surfactant functional to wet the polymeric fabric with the composition during application of the composition to the polymeric fabric. The co-surfactant is present in the composition in an amount sufficient to provide for substantially uniform distribution of the primary surfactant onto the polymeric fabric.

14 Claims, 1 Drawing Sheet

WETTABLE POLYMERIC FABRICS

TECHNICAL FIELD

This invention generally relates to polymeric fabrics, and more particularly relates to surface treatments for improving the wettability of polymeric fabrics.

BACKGROUND OF THE INVENTION

Polymeric fabrics are used to make a variety of products, some of which require the polymeric fabrics to absorb water. Such products include towels, industrial wipes, infant care products such as baby diapers, and feminine care products such as tampons. Polyolefin non-woven fabrics are polymeric fabrics which are particularly suited for these type products. This is because polyolefin non-woven fabrics are relatively economically produced.

Polyolefin non-woven fabrics and other types of polymeric fabrics tend to repel water. Thus, to effectively absorb water, the surface of polyolefin non-wovens and other types of polymeric fabrics are often surface treated with compositions which increase the wettability, of the fabric. One such conventional surface treatment is octylphenoxypolyethoxy ethanol, a non-ionic surfactant.

There are some problems with conventional surface treatment compositions used to increase the wettability of polymeric fabrics. For example, conventional surface treatment compositions are relatively easily rubbed off the fabric and are also easily washed off the fabric when the fabric is wetted. Conventional surface treatment compositions are often substantially completely removed from the polymeric fabric after only one washing. After the surface treatment is removed, the polymeric fabric again becomes water repellent and less effective to absorb water. Moreover, to compensate for the inability of conventional surface treatments to survive use, conventional surface treatments are often applied to polymeric fabrics in large quantities which increases the cost of the treated fabric. In addition to the foregoing, conventional surface treatment compositions are often skin irritants and thus are undesirable as surface treatments for fabrics used to make infant care products and feminine care products.

Therefore, there is a need for a surface treatment for improving the wettability of polymeric fabrics which survives repeated use and washing of the fabric, is less of a skin irritant and essentially medically safe, and is economical.

SUMMARY OF THE INVENTION

An object of the present invention is to provide a polymeric fabric having enhanced wettability.

Another object of the present invention is to provide an improved surface treatment for enhancing the wettability of polymeric fabric.

Another object of the present invention is to provide a surface treatment which enhances the wettability of polymeric fabric and survives repeated use and washing of the polymeric fabric.

Still another object of the present invention is to provide a more economical surface treatment which enhances the wettability of polymeric fabric.

A further object of the present invention is to provide a surface treatment which enhances the wettability of polymeric fabric and is medically safe.

Accordingly, there is provided a polymeric fabric having enhanced wettability comprising a primary surfactant on the surface of the polymeric fabric, the primary surfactant having a low solubility in water and dispersible in water. The present invention also comprehends processes for applying the primary surfactant in an aqueous solution to the surface of the polymeric fabric. In addition, the present invention provides a composition which when applied to polymeric fabric increases the wettability of the polymeric fabric.

The composition of the present invention comprises the primary surfactant, water, and a co-surfactant functional to wet the polymeric fabric with the composition during application of the composition to the polymeric fabric. The co-surfactant is present in the composition in an amount sufficient to provide for substantially uniform distribution of the primary surfactant onto the polymeric fabric.

Stated more particularly, the primary surfactant has a cloud point less than about 50° C. Such primary surfactants include organosilicones, polyethylene oxides, and polyalkylene-oxide modified castor oil. More specifically, the primary surfactants include polyalkylene oxide modified siloxanes and silanes. In a preferred embodiment, the primary surfactant comprises polyalkylene -oxide modified polydimethyl-siloxane.

Stated still more particularly, co-surfactants include, but are not limited to, primary alcohols and secondary alcohols.

In a preferred embodiment, the composition of the present invention includes the primary surfactant in an amount of about 0.1% to about 3.0% by weight of the composition and the co-surfactant in an amount of about 0.05% to about 0.6% of the composition. In a preferred embodiment of the fabric of the present invention, the primary surfactant is present on the surface of the polymeric fabric in an amount of about 0.1% to about 0.3% by weight of the treated polymeric fabric.

Polymeric fabrics surface treated with primary surfactant in accordance with the present invention exhibit enhanced wettability and are advantageously used to make water absorbent products. The surface treated polymeric fabrics of the present invention remain wettable after repeated wettings and thus may be reused. Accordingly, surface treated polymeric fabric of the present invention are more economical than conventional surface treated polymeric fabrics. The surface treated fabrics of the present invention tend to be medically safe. This is a particular advantage when the surface treated fabrics of the present invention are used to make infant wear and feminine care products.

Other features, objects, and advantages of the present invention will become apparent from the following detailed description, drawings, and claims.

DETAILED DESCRIPTION OF THE INVENTION

Figure 1:
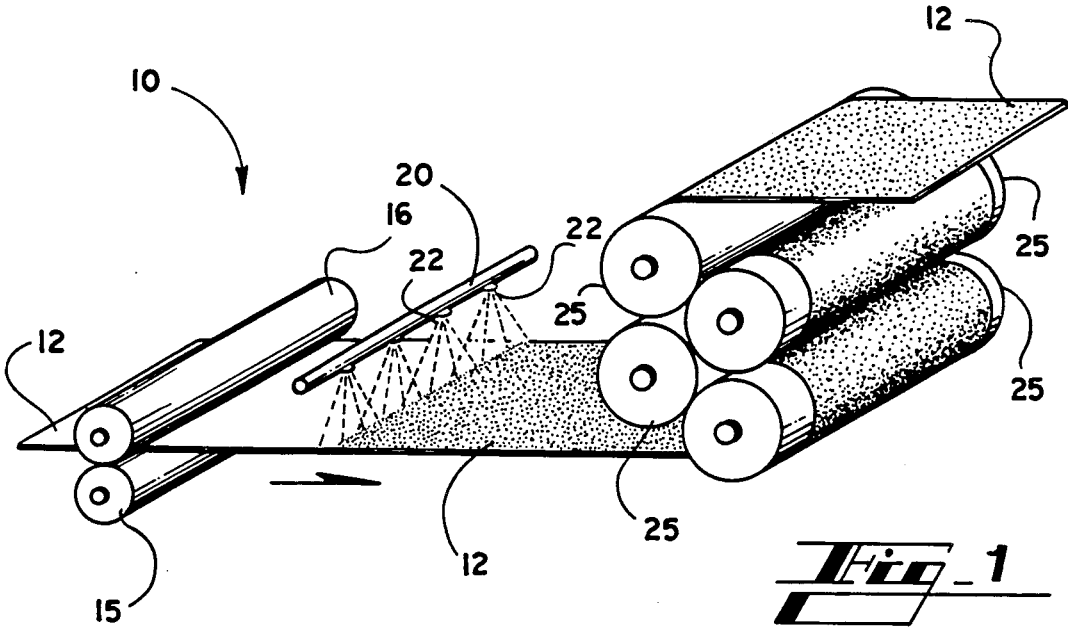
FIG. 1 is a partial perspective view of a spray applications system wherein the surface treatment of the present invention is applied to polymeric fabric.

The present invention provides for a polymeric fabric having enhanced wettability, a method for producing such wettable polymeric fabric, and a composition for use in the method. The polymeric fabrics of the present invention are suitable to make products which are used to absorb water such as towels, industrial wipes, infant care products such as diapers, and feminine care products such as tampons.

Types of polymeric fabrics which are particularly useful when surface treated according to the present invention include polyolefin non-woven fabrics, because such fabrics exhibit good absorbency characteristics and are relatively economically produced. Common polyolefin non-woven fabrics include polypropylene and polyethylene spunbonded fabrics. Such fabrics and typically produced by processes disclosed in the following patents:

| | |
|---|---|
| Appel, et al. | 4,340,563 |
| Dorschner, et al. | 3,692,618 |
| Kinney | 3,338,992 |
| Kinney | 3,341,394 |
| Levy | 3,502,538 |
| Hartmann | 3,502,763 |
| Hartmann | 3,909,009 |
| Dobo, et al. | 3,542,615 |
| Harmon (Canadian) | 803,714 |

These polyolefin non-wovens show substantially improved wettability when treated in accordance with the present invention as described below.

The wettability of polymeric fabric is enhanced according to the present invention by applying a primary surfactant onto the surface of the polymeric fabric. Generally described, the primary surfactants are of type having a low solubility in water and dispersible in water. More particularly, the primary surfactants are of the type having a cloud point less than or equal to about 50° C. The cloud point of a surfactant is the temperature at which aqueous solutions of the surfactant become cloudy when cooled at a specified rate. The cloud point data provided herein was measured using a one percent solution of the surfactant in water.

Suitable primary surfactants include organosilicones, polyethylene oxides, and polyalkylene-oxide modified castor oil. Preferred organosilicones include polyalkylene oxide modified siloxanes and silanes. Polyalkylene-oxide modified castor oil is a castor oil having one or more polyalkylene-oxide groups attached to the main carbon chain of the caster oil. Likewise, polyalkylene-oxide modified siloxanes are siloxanes having polyalkylene oxide groups attached to the main carbon chain of the siloxanes. These polyalkylene oxide modifications are well known to those of ordinary skill in the art. A particularly preferred primary surfactant is Y-12230 polyalkylene-oxide modified polydimethyl siloxane produced by Union Carbide.

The wettable polymeric fabric of the present invention preferably comprises primary surfactant in an amount of about 0.1 to about 3.0 percent by weight of the wettable polymeric fabric. According to a more preferred embodiment of the present invention, the wettable polymeric fabric comprises primary surfactant in an amount of about 0.15 to about 1.0 percent by weight of the wettable polymeric fabric.

The primary surfactant is applied to the polymeric fabric as composition comprising the primary surfactant and water. This composition preferably comprises primary surfactant in an amount of about 0.1 percent to about 0.3 percent by weight of the composition.

According to a more preferred embodiment of the present invention, the primary surfactant is applied to the polymeric fabric as a composition comprising the primary surfactant, water, and a co-surfactant. Generally described, the co-surfactant is a surfactant functional to wet the polymeric fabric with the composition during application of the composition to the polymeric fabric. The co-surfactant is preferably present in the composition in an amount sufficient to provide for substantially uniform distribution of the primary surfactant onto the polymeric fabric. When the primary surfactant is applied to polymeric fabric without the co-surfactant, the primary surfactant is not uniformly distributed over the surface of the polymeric fabric; instead, the primary surfactant tends to accumulate in concentrated zones on the surface of the fabric while other portions of the fabric surface remain substantially free of surfactant.

Particularly suitable co-surfactants include primary and secondary alcohols. Most primary and secondary alcohols and water azeotrope and evaporate relatively easily during the drying process, so that the primary and secondary alcohols are substantially completely evaporated from the treated polymeric fabric during the drying step. The surface treatment composition of the present invention preferably comprises co-surfactant in an amount of about 0.05 to about 0.6 percent by weight of the composition.

It is believed that the primary surfactants are particularly effective as surface treatments for polymeric fabrics for the following reasons. First, the primary surfactants are dispersible in water, and thus can be applied to polymeric fabrics in an aqueous dispersion. Second, the primary surfactants have a low solubility in water and thus are not easily washed off the surface of polymeric fabric after the polymeric fabric has been surface treated and dried according to the present invention.

Figure 2:
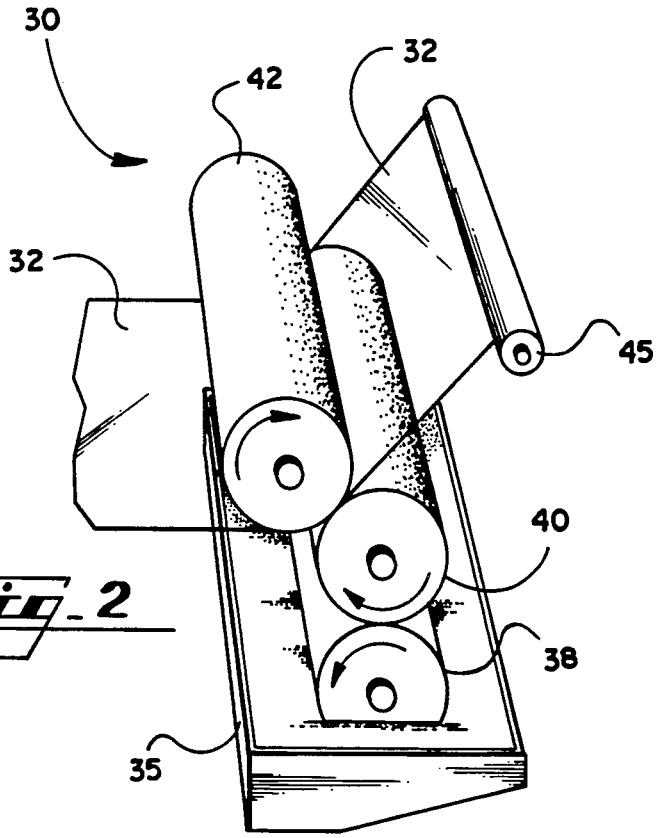
FIG. 2 is a partial perspective view of a liquid applications system wherein the surface treatment of the present invention is applied to polymeric fabric.

Surface treatment methods within the scope of the present invention include spraying a composition including the primary surfactant onto polymeric fabric as shown in FIG. 1 and applying a composition containing the primary surfactant by the liquid application systems method as shown in FIG. 2. However, it should be understood that the practice of the present invention is not limited to either of these particular methods.

Turning first to FIG. 1, a spray application system 10 is shown for applying a composition containing the primary surfactant to polymeric fabric 12. The spray application system 10 includes a pair of guide rollers 15 and 16 through which the polymeric fabric 12 initially passes. The polymeric fabric passes from the guide rollers 15 and 16 under a spray boom 20 extending across the width of the polymeric fabric. The spray boom includes a plurality of spray nozzles 22 spaced along the spray boom 20 and directed downwardly toward the polymeric fabric 12. The composition containing the primary surfactant is sprayed through the spray nozzles 22 onto the polymeric fabric 12 as the polymeric fabric passes beneath the spray boom 20. The polymeric fabric 12 passes from beneath the spray boom to a series of drying cans 25. The drying cans are steam heated to a temperature sufficient to dry the treated polymeric fabric without damaging the structure of the polymeric fabric.

A liquid application system 30 for applying a composition containing the primary surfactant to polymeric fabric 32 is shown in FIG. 2. The liquid applications system 30 includes a trough 35 containing a composition including the primary surfactant. A metering roller 38 runs substantially the length of the trough 35 and is partially submerged in the liquid composition contained in the trough. A transfer roller 40 is positioned above and parallel to the metering roller 38 so that the outer surface of the transfer roller is in contact with the outer surface of metering roller. A backing roller 42 is positioned parallel to, above and slightly to the side of the transfer roller 40 so that the outer surface of the backing roller is in contact with the outer surface of the transfer roller.

During operation of the liquid application system 30, the polymeric fabric 32 is drawn from a roll 45 through a narrow space between the transfer roller 40 and the backing roller 42 by the rotation of the backing roller. The backing roller 42 is rotated clockwise as shown in FIG. 2 and the transfer roller 40 is preferably rotated clockwise so that the surface of the transfer roller travels in a direction opposite the direction of the fabric 32. The metering roller 38 is driven counterclockwise through the liquid composition in the trough 35 by the transfer roller 40. As the metering roller 38 rotates, the outer surface of the metering roller carries the surface treatment composition from the trough 35 to the outer surface of the transfer roller 40. The transfer roller 40 then carries the surface treatment composition to the narrow space between the transfer roller and the backing roller 42 and in contact with the surface of the polymeric fabric 32 passing between the transfer roller and the backing roller. The polymeric fabric 32 passing between the transfer roller 40 and the backing roller 42 is thus treated, by reverse roll coating, with the surface treatment from the trough 35. The treated polymeric fabric 32 is then dried leaving the primary surfactant on the surface of the polymeric fabric.

This invention is further illustrated by the following examples which are illustrative of certain embodiments designed to teach those of ordinary skill in the art how to practice this invention and to represent the best mode contemplated for carrying out this invention.

EXAMPLE 1

Polypropylene spunbonded diaper liner fabric having a basis weight of 0.75 ounces per square yard was surface treated with a surface treatment composition using the spray application system 10 shown in FIG. 1. The surface treatment composition comprised 0.40 weight percent Y-12230 polyalkylene-oxide modified polydimethyl-siloxane, which has a cloud point less than 10° C. and is produced by Union Carbide, 0.30 weight percent hexanol, and water as the remainder. The fabric line speed was 90 feet per minute and the flow rate of the surface treatment composition from the spray boom onto the fabric was 0.115 gallons per minute. The wet pick up of the fabric was 75 weight percent. The steam heated drying cans were operated at 25 psig (245° F.). The dry weight add-on of the modified polydimethyl siloxane was 0.29 weight percent of the treated fabric.

The dried treated fabric from Example 1 was subjected to a run-off test, the procedure of which was as follows. A 5 inch×15 inch piece of the treated fabric was placed flat on top of an absorbent medium which was positioned at a 30° inclined plane. A funnel was placed above the fabric. 100 mls of distilled water at 35° C.±0.6° C. was dispensed from the funnel onto the fabric over a time period of 15 seconds±1.5 seconds. Any of the distilled water that was not absorbed by the fabric ran off the fabric and was collected. The volume of run-off water was measured.

After the run-off test the piece of treated fabric was removed from the inclined plane and washed in a container of water. The piece of treated fabric was submerged in 500 mls of water at 25° C. The treated fabric was agitated in the water for one minute.

The piece of treated fabric was then removed from the container of water and dried in an oven at 200° F. for eight minutes. The piece of treated fabric was repeatedly subjected to the run-off test and then washed according to the foregoing procedure until the amount of run-off water from the run-off test exceeded 20 mls. The results of each run-off test of Example 1 are shown in Table 1.

EXAMPLE 2

A comparative example of treated fabric was prepared by treating polypropylene spunbonded fabric with a conventional surface treatment composition according to the process described in Example 1. The conventional surface treatment composition comprised 0.33 weight percent Triton X-102, and actyl-phenoxypolyethoxy ethanol non-ionic surfactant which has a cloud point of 88° C. and is produced by Rohm and Haas. The dry add-on of the Triton X-102 surfactant was 0.21 percent by weight of the treated fabric.

The treated fabric from Example 2 was subjected to the same run-off tests and washings as the treated fabric from Example 1 and the results of such tests are shown in Table 1. As can be seen from Table 1, the fabric from Example 1 treated in accordance with the present invention remained absorbent even after repeated washings, whereas the fabric from Example 2 treated with convention surface treatments did not.

TABLE 1

| Run-Off Test | Example 1 Run-Off Water (mls) | Example 2 Run-Off Water (mls) |
|---|---|---|
| Initial | 0.0 | 0.0 |
| After 1st wash | 0.0 | 93.7 |
| After 2nd wash | 0.0 | — |
| After 3rd wash | 60.3 | — |

EXAMPLE 3

Polypropylene spunbonded diaper liner fabric having a basis weight of 0.75 ounces per square yard was surface treated with a surface treatment composition using the liquid application system 30 shown in FIG. 2. The surface treatment composition comprised 1.67 weight percent Y-12230 polyalkylene oxide modified polydimethyl-siloxane produced by Union Carbide, 0.30 weight percent hexanol, and water as the remainder. The fabric line speed was 500 feet per minute, the metering roller speed was 200 feet per minute, and the transfer roller speed was 1100 feet per minute. The wet treated fabric was dried by passing the fabric over the surface of steam heated dryer cans operating at 250° F. The dry weight add-on of the modified polydimethyl siloxane was 0.52 percent by weight of the treated fabric.

The treated fabric from Example 3 was subjected to the same run-off tests and washings as the treated fabric from Example 1 and the results of such tests are shown in Table 2. As shown in Table 2, the fabric from Example 3 treated in accordance with the present invention remained absorbent after repeated washings.

EXAMPLE 4

Polypropylene spunbonded diaper liner fabric having a basis weight of 0.75 ounces per square yard was surface treated according to the same procedure described in Example 3 except that the surface treatment composition comprised 2.50 weight percent Y-12230 polyalkylene oxide modified polydimethyl siloxane produced by Union Carbide and 0.6 weight percent hexanol and the transfer roller speed was 1300 feet per minute. The dry weight add-on of the modified polydimethyl siloxane was 0.81 percent by weight of the treated fabric.

The treated fabric from Example 4 was subjected to the same run-off tests and washings as the treated fabric from Example 1 and the results of such tests are shown in Table 2. The fabric from Example 4 treated in accordance with the present invention also remained absorbent after repeated washings.

TABLE 2

| Run-Off Test | Example 3 Run-Off Water (mls) | Example 4 Run-Off Water (mls) |
|---|---|---|
| Initial | 0.0 | 0.0 |
| After 1st wash | 0.0 | 0.0 |
| After 2nd wash | 0.3 | 0.2 |
| After 3rd wash | 67.6 | 34.7 |

EXAMPLE 5

Polypropylene spunbonded diaper liner fabric having a basis weight of 0.75 ounces per square yard was surface treated according to the same procedure described in Example 1 except that the surface treatment composition comprised 0.40 weight percent TEGOPREN 5863 polyalkylene oxide modified polydimethyl siloxane which has a cloud point of 44°±3° C. and is produced by Goldschmidt Chemical of West Germany, and 0.05 weight percent GEMTEX SM-33 surfactant produced by Finetex Corporation. The dry weight add-on of the modified polydimethyl siloxane was 0.37 percent by weight of the treated fabric.

The treated fabric from Example 5 was subjected to the same run-off tests and washings as the treated fabric from Example 1 and the results of such tests are shown in Table 3. As shown in Table 3, the fabric from Example 5 treated in accordance with the present invention remained absorbent even after repeated washings.

TABLE 3

| Run-Off Test | Example 5 Run-Off Water (mls) |
|---|---|
| Initial | 0.0 |
| After 1st wash | 0.0 |
| After 2nd wash | 0.0 |
| After 3rd wash | 90.0 |

It should be understood that the foregoing relates only to preferred embodiments of the present invention, and that numerous changes therein may be made without departing from the spirit and scope of the invention as defined by the following claims.

We claim:

1. A composition for increasing the wettability of polymeric fabric, the composition comprising:

a primary surfactant of the type having a low solubility in water and dispersible in water;

water; and a co-surfactant functional to wet the polymeric fabric with the composition during application of the composition to the polymeric fabric, and present in an amount sufficient to provide for substantially uniform distribution of the primary surfactant onto the polymeric fabric.

2. A composition as in claim 1, wherein the primary surfactant has a cloud point less than about 50° C.

3. A composition as in claim 1, wherein the primary surfactant is selected from the group consisting of organosilicones, polyethylene oxides, a polyalkylene oxide modified castor oil.

4. A composition as in claim 2, wherein the primary surfactant comprises an organosilicone.

5. A composition as in claim 4, wherein the co-surfactant is selected from the group consisting of primary alcohols and secondary alcohols.

6. A composition as in claim 5, wherein:

the primary surfactant is present in an amount of from about 0.1 percent to about 3.0 percent by weight of the composition; and the co-surfactant is present in an amount of from about 0.05 percent to about 0.6 percent by weight of the composition.

7. A composition as in claim 2, wherein the primary surfactant is selected from the group consisting of polyalkylene oxide modified siloxanes and silanes.

8. A composition as in claim 7, wherein the co-surfactant is selected from a group consisting of primary alcohols and secondary alcohols.

9. A composition as in claim 8, wherein:

the primary surfactant is present in an amount of from about 0.1 percent to about 3.0 percent by weight of the composition; and the co-surfactant is present in an amount of from about 0.05 percent to about 0.6 percent by weight of the composition.

10. A wettable polymeric fabric comprising:

a normally water repelling polymeric fabric having a surface; and a primary surfactant having a cloud point less than about 50°C. substantially uniformly distributed on the surface of the polymeric fabric, the primary surfactant also having a low solubility in water and being dispersible in water.

11. A wettable polymeric fabric as in claim 10, wherein the primary surfactant is selected from the group consisting of organosilicones, polyethylene oxides, and polyalkylene oxide modified castor oil.

12. A wettable polmeric fabric as in claim 10, where in the primary surfactant comprises an organosilicone.

13. A wettable polymeric fabric as in claim 12, wherein the primary surfactant is present in an amount of about 0.1 percent to about 0.3 percent by weight of the wettable polymeric fabric.

14. A wettable polymeric fabric as in claim 10, wherein the primary surfactant is selected from the group consisting of polyalkylene oxide modified siloxanes and silanes.

15. A wettable polymeric fabric as in claim 14, wherein the primary surfactant is present in an amount of about 0.1 percent to about 0.3 percent by weight of the wettable polymeric fabric.

16. A wettable non-woven polymeric fabric comprising:

a normally water repelling non-woven polyolefin fabric having a surface; and a primary surfactant having a cloud point less than about 50° C. substantially uniformly distributed on the surface of the polymeric fabric, the surfactant having a low solubility in water and being dispersible in water.

17. A wettable polymeric fabric as in claim 16, wherein the primary surfactant is selected from the group consisting of organosilicones, polyethylene oxides, and polyalkylene oxide modified castor oil.

18. A wettable polymeric fabric as in claim 16, wherein the primary surfactant comprises an organosilicone.

19. A wettable polymeric fabric as in claim 18, wherein the primary surfactant is present in an amount of about 0.1 percent to about 0.3 percent by weight of the wettable polymeric fabric.

20. A wettable polymeric fabric as in claim 16, wherein the primary surfactant is selected from the group consisting of polyalkylene oxide modified siloxanes and silanes.

21. A wettable polymeric fabric as in claim 20, wherein the primary surfactant is present in an amount of about 0.1 percent to about 0.3 percent by weight of the wettable polymeric fabric.

22. A process for increasing the wettability of polymeric fabric, the process comprising the steps of:

providing a polymeric fabric having a surface; and applying to the surface of the polymeric fabric a composition comprising water and a primary surfactant of the type having a low solubility in water and dispersible in water, said application resulting in substantially uniform distribution of said primary surfactant.

23. A process as in claim 22, wherein the primary surfactant has a cloud point less than about 50° C.

24. A process as in claim 23, wherein the primary surfactant is selected from the group consisting of organosilicones, polyethylene oxides, and polyalkylene oxide modified castor oil.

25. A process as in claim 23, wherein the primary surfactant comprises an organosilicone.

26. A process as in claim 25, wherein the step of applying the primary surfactant is carried out so as to add the primary surfactant to the polymeric fabric in an amount from about 0.1 percent to about 0.3 percent by weight of the wettable polymeric fabric.

27. A process as in claim 25, wherein:

the primary surfactant is present in the composition in an amount of about 0.1 percent to about 3.0 percent by weight of the composition.

28. A process as in claim 23, wherein the primary surfactant is selected from the group consisting of polyalkylene oxide modified siloxanes and silanes.

29. A process as in claim 28 wherein the step of applying the primary surfactant is carried out so to add the primary surfactant to the polymeric fabric in an amount from about 0.1 percent to about 0.3 percent by weight of the wettable polymeric fabric.

30. A process as in claim 28, wherein the primary surfactant is present in the composition in an amount of about 0.1 percent to about 3.0 percent by weight of the composition.

31. A process as in claim 22, wherein the composition applied to the surface of the polymeric fabric further comprises a co-surfactant functional to wet the surface of the polymeric fabric with the composition during the application step, and present in the composition in an amount sufficient to provide for substantially uniform distribution of the primary surfactant onto the surface of the polymeric fabric.

32. A process as in claim 31, wherein the primary surfactant has a cloud point less that about 50° C.

33. A process as in claim 32, wherein the primary surfactant is selected from the group consisting of organosiicones, polyethylene oxides, and polyalkylene oxide modified castor oil.

34. A process as in claim 32, wherein the primary surfactant comprises an organosilicone.

35. A process as in claim 34, wherein the co-surfactant is selected from the group consisting of primary alcohols and secondary alcohols.

36. A process as in claim 35, wherein:

the primary surfactant is present in an amount of from about 0.1 percent to about 3.0 percent by weight of the composition; and the co-surfactant is present in an amount of from about 0.05 percent to about 0.6 percent by weight of the composition.

37. A process as in claim 35, wherein the step of applying the primary surfactant is carried out so as to add the primary surfactant to the polymeric fabric in an amount from about 0.1 percent to about 0.3 percent by weight of the wettable polymeric fabric.

38. A process as in claim 32, wherein the primary surfactant is selected from the group consisting of polyalkylene oxide modified siloxanes and silanes.

39. A process as in claim 38, wherein the co-surfactant is selected from the group consisting of primary alcohols and secondary alcohols.

40. A process as in claim 39, wherein:

the primary surfactant is present in an amount of from about 0.1 percent to about 3.0 percent by weight of the composition; and the co-surfactant is present in an amount of from about 0.05 percent to about 0.6 percent by weight of the composition.

41. A process as in claim 39, wherein:

the step of applying the primary surfactant is carried out so as to add the primary surfactant to the polymeric fabric in an amount from about 0.1 percent to about 0.3 percent by weight of the wettable polymeric fabric.

* * * * *